US012065923B2

(12) United States Patent
Li et al.

(10) Patent No.: US 12,065,923 B2
(45) Date of Patent: Aug. 20, 2024

(54) DRILLING METHOD AND DRILLING APPARATUS

(71) Applicant: INSTITUTE OF GEOLOGY AND GEOPHYSICS, CHINESE ACADEMY OF SCIENCES, Beijing (CN)

(72) Inventors: Shouding Li, Beijing (CN); Xiao Li, Beijing (CN); Dong Chen, Beijing (CN); Siyuan Wu, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 443 days.

(21) Appl. No.: 17/219,386

(22) Filed: Mar. 31, 2021

(65) Prior Publication Data

US 2022/0170360 A1 Jun. 2, 2022

(30) Foreign Application Priority Data

Nov. 27, 2020 (CN) ..... 202011367591.8

(51) Int. Cl.
*E21B 44/00* (2006.01)
*E21B 49/00* (2006.01)

(52) U.S. Cl.
CPC ..... *E21B 44/005* (2013.01); *E21B 49/003* (2013.01); *E21B 2200/22* (2020.05)

(58) Field of Classification Search
CPC .. E21B 44/005; E21B 49/003; E21B 2200/22; E21B 7/00; E21B 44/00
See application file for complete search history.

(56) References Cited

U.S. PATENT DOCUMENTS

2002/0120401 A1 8/2002 Macdonald et al.
2009/0114445 A1 5/2009 Dashevskiy
(Continued)

FOREIGN PATENT DOCUMENTS

CN 104975808 A 10/2015
CN 106640033 A * 5/2017 ..... E21B 44/00
(Continued)

OTHER PUBLICATIONS

Office Action for Chinese Patent Application No. 202011367591.8 (Jul. 1, 2021).

*Primary Examiner* — Douglas Kay
(74) *Attorney, Agent, or Firm* — Merchant & Gould P.C.

(57) ABSTRACT

A drilling method and a drilling apparatus are provided. In the method, the feature parameter of the stratum around the well, the feature parameter of the stratum in front of the drill bit, the preset drilling parameter, the preset trajectory parameter, the current pose of the drill bit and the current rate of penetration of the drill bit are obtained; the feature parameter of the reservoir in front of the drill bit is determined based on the feature parameter of the stratum around the well and the feature parameter of the stratum in front of the drill bit; the above parameters are inputted to the pre-trained drilling parameter modification model to obtain drilling trajectory parameter and drilling speed parameters; and the drilling direction and the rate of penetration are regulated based on the above parameters.

8 Claims, 2 Drawing Sheets

(56) References Cited

U.S. PATENT DOCUMENTS

| | | | | |
|---|---|---|---|---|
| 2011/0280104 | A1* | 11/2011 | McClung, III | E21B 3/022 175/170 |
| 2012/0316787 | A1* | 12/2012 | Moran | E21B 44/00 702/9 |
| 2014/0116776 | A1 | 5/2014 | Marx et al. | |
| 2020/0149386 | A1 | 5/2020 | Menand | |
| 2020/0362686 | A1 | 11/2020 | Puwanto et al. | |
| 2021/0148213 | A1* | 5/2021 | Madasu | E21B 49/003 |
| 2023/0041525 | A1* | 2/2023 | Hong | G06N 20/20 |

FOREIGN PATENT DOCUMENTS

| | | | | |
|---|---|---|---|---|
| CN | 110685600 | A | 1/2020 | |
| CN | 110852018 | A | 2/2020 | |
| WO | WO-2017083454 | A1 * | 5/2017 | E21B 19/008 |

* cited by examiner

DRILLING METHOD AND DRILLING APPARATUS

The present application claims the priority to Chinese Patent Application No. 202011367591.8, titled "DRILLING METHOD AND DRILLING APPARATUS", filed on Nov. 27, 2020 with the Chinese Patent Office, which is incorporated herein by reference in its entirety.

FIELD

The present disclosure generally relates to the technical field of exploration and development of geological resources, and in particular to a drilling method and a drilling apparatus.

BACKGROUND

Oil and natural gas are strategic resources and are the "blood" for developing national economic. With the increasing exploration and development of oil-gas fields and the deepening of oil-gas wells in China and abroad, efficient development of deep and ultra-deep oil and gas resources is a major requirement for an energy replacement strategy in China, and is the hotspot in the current and future exploration and development of the oil and gas resources. The method for exploring deep and ultra-deep wells based on the geo-steering technology and the rotary steering technology is currently the most automatic drilling method in the drilling field. With the method, the oil-gas drilling rate, the drilling efficiency and the wellbore quality can be effectively improved.

In practices, the above method is performed based on efficient transmission of well-ground data. A drilling system located underground transmits real-time drilling information to a well-site system located on the ground. The technician in the well site regulates the rate of penetration and the drilling trajectory of the drill bit based on the real-time drilling information presented by the well-site system.

According to the conventional technology, the well-ground data is transmitted based on a mud pulse method, in which the drilling fluid flowing in the drill string serves as a transmission channel, and information is transmitted through a baseband or a passband in a form of a coded pressure pulse or a wave. However, the mud pulse signal gradually attenuates as the well is deepened and the transmission rate of the mud pulse signal is limited, resulting in that the reliability and efficiency of the transmission of the well-ground data cannot be ensured, thereby increasing the risk of the drill bit drilling out of the reservoir and even affecting the safety of the drilling process.

SUMMARY

In view of the above, a drilling method and a drilling apparatus are provided according to the present disclosure. With the present disclosure, a drilling system can independently regulate a drilling direction and a rate of penetration of a drill bit and independently control the operation of the drill bit, performing the drilling process without depending on the transmission of the well-ground data, overcoming the shortcomings of the conventional technology, and thereby improving the safety of the drilling process. Technical solutions of the present disclosure are described below.

According to a first aspect of the present disclosure, a drilling method is provided. The method is applied to a drilling system, and the method includes:

obtaining a feature parameter of a stratum around a well, a feature parameter of a stratum in front of a drill bit, a preset drilling parameter, a preset trajectory parameter, a current pose of the drill bit, and a current rate of penetration of the drill bit;

determining, based on the feature parameter of the stratum around the well and the feature parameter of the stratum in front of the drill bit, a feature parameter of a reservoir in front of the drill bit;

inputting the preset drilling parameter, the preset trajectory parameter, the current pose of the drill bit and the feature parameter of the reservoir to a pre-trained drilling parameter modification model to obtain a drilling trajectory parameter and a drilling speed parameter; and regulating a drilling direction and a rate of penetration of the drill bit based on the drilling trajectory parameter, the drilling speed parameter, the current pose of the drill bit and the current rate of penetration of the drill bit.

In an embodiment, the regulating a drilling direction and a rate of penetration of the drill bit based on the drilling trajectory parameter, the drilling speed parameter, the current pose of the drill bit and the current rate of penetration of the drill bit includes:

calculating a biasing force parameter and a drilling parameter based on the drilling trajectory parameter, the drilling speed parameter, the current pose of the drill bit and the current rate of penetration of the drill bit;

sending the biasing force parameter to a rotary guiding mechanism of the drilling system to regulate the drilling direction of the drill bit by the rotary guiding mechanism based on the biasing force parameter; and sending the drilling parameter to an automatic rig of the drilling system to regulate the rate of penetration of the drill bit by the automatic rig based on the drilling parameter.

In an embodiment, the calculating a biasing force parameter and a drilling parameter based on the drilling trajectory parameter, the drilling speed parameter, the current pose of the drill bit and the current rate of penetration of the drill bit includes:

calling a preset closed-loop control model; and inputting the drilling trajectory parameter, the drilling speed parameter, the current pose of the drill bit and the current rate of penetration of the drill bit to the preset closed-loop control model to obtain the biasing force parameter and the drilling parameter.

In an embodiment, the determining, based on the feature parameter of the stratum around the well and the feature parameter of the stratum in front of the drill bit, a feature parameter of a reservoir in front of the drill bit includes:

calling a pre-trained parameter inversion model, where the parameter inversion model is obtained by training an artificial intelligence model using feature parameters of stratums around a well and feature parameters of stratums in front of a drill bit as inputs and using feature parameters of reservoirs as outputs; and inputting the feature parameter of the stratum around the well and the feature parameter of the stratum in front of the drill bit to the parameter inversion model to obtain the feature parameter of the reservoir in front of the drill bit.

In an embodiment, the drilling method according to the first aspect of the present disclosure further includes: sending the drilling trajectory parameter and the drilling speed parameter to a wellsite control system.

According to a second aspect of the present disclosure, a drilling apparatus is provided. The apparatus includes an obtaining unit, a determination unit, a calculation unit and a controlling unit.

The obtaining unit is configured to obtain a feature parameter of a stratum around a well, a feature parameter of a stratum in front of a drill bit, a preset drilling parameter, a preset trajectory parameter, a current pose of the drill bit and a current rate of penetration of the drill bit.

The determination unit is configured to determine, based on the feature parameter of the stratum around the well and the feature parameter of the stratum in front of the drill bit, a feature parameter of a reservoir in front of the drill bit.

The calculation unit is configured to input the preset drilling parameter, the preset trajectory parameter, the current pose of the drill bit and the feature parameter of the reservoir to a pre-trained drilling parameter modification model to obtain a drilling trajectory parameter and a drilling speed parameter.

The controlling unit is configured to regulate a drilling direction and a rate of penetration of the drill bit based on the drilling trajectory parameter, the drilling speed parameter, the current pose of the drill bit and the current rate of penetration of the drill bit.

In an embodiment, the controlling unit, in regulating the drilling direction and the rate of penetration of the drill bit based on the drilling trajectory parameter, the drilling speed parameter, the current pose of the drill bit and the current rate of penetration of the drill bit, is configured to:

calculate a biasing force parameter and a drilling parameter based on the drilling trajectory parameter, the drilling speed parameter, the current pose of the drill bit and the current rate of penetration of the drill bit;

send the biasing force parameter to a rotary guiding mechanism of the drilling system to regulate the drilling direction of the drill bit by the rotary guiding mechanism based on the biasing force parameter; and send the drilling parameter to an automatic rig of the drilling system to regulate the rate of penetration of the drill bit by the automatic rig based on the drilling parameter.

In an embodiment, the controlling unit, in calculating the biasing force parameter and the drilling parameter based on the drilling trajectory parameter, the drilling speed parameter, the current pose of the drill bit and the current rate of penetration of the drill bit, is configured to:

call a preset closed-loop control model; and input the drilling trajectory parameter, the drilling speed parameter, the current pose of the drill bit and the current rate of penetration of the drill bit to the preset closed-loop control model to obtain the biasing force parameter and the drilling parameter.

In an embodiment, the determination unit, in determining the feature parameter of the reservoir in front of the drill bit based on the feature parameter of the stratum around the well and the feature parameter of the stratum in front of the drill bit, is configured to:

call a pre-trained parameter inversion model, where the parameter inversion model is obtained by training an artificial intelligence model using feature parameters of stratums around a well and feature parameters of stratums in front of a drill bit as inputs and using feature parameters of reservoirs as outputs; and input the feature parameter of the stratum around the well and the feature parameter of the stratum in front of the drill bit to the parameter inversion model to obtain the feature parameter of the reservoir in front of the drill bit.

In an embodiment, the drilling apparatus according to the second aspect of the present disclosure further includes a sending unit. The sending unit is configured to send the drilling trajectory parameter and the drilling speed parameter to a wellsite control system.

Based on the technical solutions described above, with the drilling method according to the present disclosure, the drilling system, after obtaining the feature parameter of the stratum around the well, the feature parameter of the stratum in front of the drill bit, the preset drilling parameter, the preset trajectory parameter, the current pose of the drill bit and the current rate of penetration of the drill bit, determines the feature parameter of the reservoir in front of the drill bit based on the feature parameter of the stratum around the well and the feature parameter of the stratum in front of the drill bit, inputs the preset drilling parameter, the preset trajectory parameter, the current pose of the drill bit and the feature parameter of the reservoir to the pre-trained drilling parameter modification model to obtain the drilling trajectory parameter and the drilling speed parameter, and regulates the drilling direction and the rate of penetration of the drill bit based on the drilling trajectory parameter, the drilling speed parameter, the current pose of the drill bit and the current rate of penetration of the drill bit. With the drilling method according to the present disclosure, the drilling system can independently regulate the drilling direction and the rate of penetration of the drill bit and independently control the operation of the drill bit, independently performing the drilling process without depending on the control information of the wellsite system. The limitation of the reliability and efficiency of the transmission of the well-ground data according to the conventional technology does not affect the drilling process, thereby overcoming the shortcomings of the conventional technology and improving the safety of the drilling process.

Furthermore, with the method, the dependence on engineers of the drilling process according to the conventional technology can be overcome, reducing the influence of personnel experiences on the drilling process.

BRIEF DESCRIPTION OF THE DRAWINGS

In conjunction with the drawings and with reference to the following embodiments, the above and other features, advantages and aspects of the embodiments of the present disclosure are more apparent. The same or similar reference numerals throughout the drawings represent the same or similar elements. It should be understood that the drawings are schematic and the components and elements are unnecessarily drawn to scale.

DETAILED DESCRIPTION OF EMBODIMENTS

Figure 1:
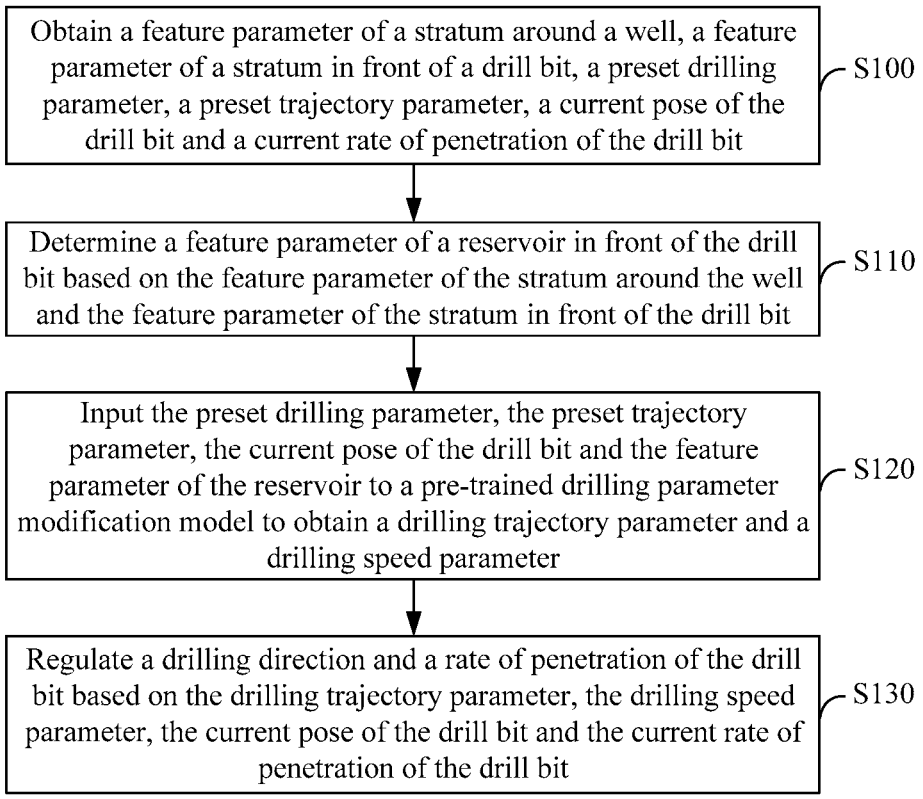
FIG. 1 is a flow chart of a drilling method according to an embodiment of the present disclosure.

The embodiments of the present disclosure are described in detail below with reference to the drawings. Although some embodiments of the present disclosure are shown in the drawings, it should be understood that the present disclosure may be implemented in various forms and should not be limited to the embodiments. The embodiments are provided for thoroughly and completely understanding the present disclosure. It should be understood that the drawings and the embodiments of the present disclosure are exemplary and are not intended to limit the protection scope of the present disclosure.

The term "include" and its variations in the present disclosure means open-ended inclusion, that is, "including but not limited to". The term "based on" means "based at least in part on". The term "one embodiment" means "at least one embodiment". The term "another embodiment" means "at least one additional embodiment". The term "some embodiments" means "at least some embodiments". The definitions of other terms are provided in the following descriptions.

It should be noted that the concepts such as "first" and "second" mentioned in the present disclosure are used to distinguish different devices, modules or units, and are not used to limit an sequential order or interdependence of the functions performed by the devices, modules or units.

It should be noted that the modifications such as "one" and "multiple" mentioned in the present disclosure are illustrative and not restrictive. Those skilled in the art should understand that the modifications should be understood as "one or more" unless otherwise expressly indicated in the context.

Reference is made to FIG. 1, which is a flow chart of a drilling method according to an embodiment of the present disclosure. The drilling method according to the present disclosure may be applied to a drilling system. The drilling method may be applied to a controller in the drilling system. The controller can obtain parameters, run control programs, and control the drilling direction and the rate of penetration of the drill bit. Apparently, in some cases, the drilling method may be applied to a server at a network side. The drilling method according to the present disclosure includes the following steps S100 to S130.

In step S100, a feature parameter of a stratum around a well, a feature parameter of a stratum in front of a drill bit, a preset drilling parameter, a preset trajectory parameter, a current pose of the drill bit and a current rate of penetration of the drill bit are obtained.

In the conventional drilling system, a large number of measuring tools, such as various types of sensors, are provided. With these sensors, geophysical parameters of the stratum can be obtained accurately and efficiently in the drilling process.

In the drilling method according to the embodiment of the present disclosure, the feature parameter of the stratum around the well is obtained by using a geosteering tool. The feature parameter of the stratum around the well includes at least an azimuth acoustic wave electromagnetic wave imaging parameter, a resistivity imaging parameter, an azimuth acoustic imaging parameter, a neutron parameter, a density parameter, a gamma energy spectrum parameter, a nuclear magnetic resonance parameter, a stratum testing-sampling parameter, and so on. With the geosteering tool, the geophysical parameters of the stratum around the well are obtained to perceive the feature of the stratum around the well. These parameters are inputted to a parameter intelligent inversion model in an intelligent decision module to provide a basis for a drilling decision.

The feature parameter of the stratum in front of the drill bit is obtained by using an electromagnetic pre-detection and seismic while drilling tool. With the electromagnetic pre-detection and seismic while drilling tool, the stratum in front of the drill bit is pre-detected to obtain parameters such as stratum lithology parameter, stratum structure parameter and stratum geomechanical feature parameter. It should be noted that the stratum in front of the drill bit mentioned in the embodiments of the present disclosure refers to a stratum in a forward direction of the drill bit while drilling and has no corresponding relationship with the orientation of the drill bit defined in physical structure.

In practices, the current pose of the drill bit includes position coordinates of the drill bit and a posture of the drill bit. For the representation of the posture of the drill bit, one may refer to the conventional technology, which is not limited in the present disclosure. The current pose of the drill bit is obtained by using a measuring while drilling tool. With the measuring while drilling tool, parameters such as a geomagnetic azimuth parameter and a gravity well deviation parameter are obtained, and based on these parameters, the position coordinates of the drill bit and the posture of the drill bit are determined to calculate the well trajectory in real time. In addition, the current rate of penetration of the drill bit may be obtained by using the measuring while drilling tool. It should be emphasized that in the embodiment, the pose of the drill bit is required to be real-time, that is, the obtained pose of the drill bit and the obtained rate of penetration of the drill bit are respectively a pose of the drill bit and a rate of penetration of the drill bit at a current time instant or in a current control period. Based on the current pose of the drill bit and the current rate of penetration of the drill bit, the drilling direction of the drill bit and the drilling progress can be obtained timely, thereby providing effective data for regulating the drilling direction and the rate of penetration of the drill bit in subsequent steps.

It should be noted that any methods with which the feature parameter of the stratum around the well, the feature parameter of the stratum in front of the drill bit and the current pose of the drill bit can be obtained are optional, and the methods, without exceeding the concept of the present disclosure, fall in the protection scope of the present disclosure.

The preset trajectory parameter is obtained based on an initial drilling trajectory parameter sequence and a three-dimensional geological model in the drilling design process, where the three-dimensional geological model is constructed based on block wellsite geology parameters, geophysical parameters and historical drilling data. The preset trajectory parameter serves as a basic trajectory parameter in subsequent steps.

The preset drilling parameter is a preset drilling engineering and hydraulic parameter which is obtained in the drilling design process. The preset drilling parameter is obtained based on an initial drilling engineering parameter sequence, a trajectory parameter, a stratum feature parameter, and a stratum structure parameter. The preset drilling parameter serves as a basic drilling parameter in subsequent steps.

It should be noted that the preset trajectory parameter and the preset drilling parameter may be determined according to the conventional technology, and how to determine the trajectory parameter and the preset drilling parameter is not limited in the present disclosure.

In step S110, a feature parameter of a reservoir in front of the drill bit is determined based on the feature parameter of the stratum around the well and the feature parameter of the stratum in front of the drill bit.

In an embodiment, in order to accurately determine the feature parameter of the reservoir in front of the drill bit to evaluate the stratum feature of the reservoir in front of the drill bit and the oil-gas sweet spot in the reservoir in front of the drill bit based on the feature parameter of the reservoir, a parameter inversion model is pre-trained. The parameter inversion model is obtained by training an artificial intelligence model using feature parameters of stratums around a well and feature parameters of stratums in front of a drill bit as inputs and using feature parameters of reservoirs as outputs. For example, a random forest model may be selected for training.

As described above, the feature parameter of the stratum around the well and the feature parameter of the stratum in front of the drill bit include geophysical parameters such as a natural gamma parameter, a density parameter, an acoustic wave parameter, a neutron parameter and a resistivity parameter. Using these parameters as inputs and using feature parameters of reservoirs such as porosities, permeability, water saturations and shale contents as outputs, the artificial intelligence model is continuously evolved to obtain the parameter inversion model suitable for the application scenario in the present disclosure. Compared with the conventional technology, with the parameter inversion model, oil, gas, water layer and the structural feature of the stratum in front of the drill bit can be distinguished quickly and accurately, providing basic data for evaluating the stratum feature of the reservoir in front of the drill bit and the oil-gas sweet spot in the reservoir in front of the drill bit.

In this step, after the parameters described in step S100 are obtained, the pre-trained parameter inversion model is called, and the feature parameter of the stratum around the well and the feature parameter of the stratum in front of the drill bit are inputted to the parameter inversion model to obtain the feature parameter of the reservoir in front of the drill bit.

It should be noted that parameters included in the feature parameter of the reservoir may be flexibly selected according to actual evaluation requirements for accurately and comprehensively evaluating the feature parameter of the stratum in front of the drill bit. The parameters included in the feature parameter of the reservoir are not limited in the present disclosure.

In step S120, the preset drilling parameter, the preset trajectory parameter, the current pose of the drill bit and the feature parameter of the reservoir are inputted to a pre-trained drilling parameter modification model to obtain a drilling trajectory parameter and a drilling speed parameter.

In designing the drilling trajectory according to the conventional technology, based on the geological stratification and data of a target point or a target well section which are provided by a geological and oil production department, a drilling trajectory meeting design requirements is calculated by using a mathematical algorithm with a model based on a spatial geometric curve equation such as a cylindrical spiral, a spatial arc and a natural curve. In the conventional trajectory design methods, a numerical iteration algorithm is used to solve problems, not meeting the requirements of trajectory design for complex oil-gas reservoirs and real-time optimization of the drilling trajectory. The dependence of the numerical iteration algorithm on an initial value results in that no solution is obtained after multiple iterations or a numerical solution is not a true solution meeting actual engineering conditions, seriously hindering the development of the automatic drilling technology.

To solve the above problem, a pre-trained drilling parameter modification model is provided according to the embodiments of the present disclosure. The drilling parameter modification model is trained using preset drilling parameters, preset trajectory parameters, poses of a drill bit and feature parameters of reservoirs as inputs and using drilling trajectory parameters and drilling speed parameters of the drill bit as outputs. The preset drilling parameter, the preset trajectory parameter, the current pose of the drill bit and the feature parameter of the reservoir are inputted to the pre-trained drilling parameter modification model to obtain the drilling trajectory parameter and the drilling speed parameter of the drill bit drilling in a next control period.

In practices, there are many models or algorithms for training the drilling parameter modification model. A finite state machine model, a reinforcement learning model, a decision tree model, a neural network model or a Bayesian network model may be selected. The process of training the drilling parameter modification model is not limited in the present disclosure. In practices, based on a training method according to the conventional technology, the drilling parameter modification model may be trained by using the selected model or algorithm. However, any applicable model using the preset drilling parameter, the preset trajectory parameter, the pose of the drill bit and the feature parameter of the reservoir as an input and using the drilling trajectory parameter and the drilling speed parameter of the drill bit as an output, without exceeding the scope of the concept of the present disclosure, fall in the protection scope of the present disclosure.

Compared with the conventional technology, the drilling trajectory parameter and the drilling speed parameter determined by the intelligent model according to the present disclosure are more accurate and reliable, and based on these parameters, the drilling trajectory does not deviate from the reservoir and passes through more geological sweet spots, thereby performing a high quality and efficiency drilling process.

In step S130, a drilling direction and a rate of penetration of the drill bit are regulated based on the drilling trajectory parameter, the drilling speed parameter, the current pose of the drill bit and the current rate of penetration of the drill bit.

After the drilling trajectory parameter, the drilling speed parameter, the current pose of the drill bit and the current rate of penetration of the drill bit are obtained, the drilling direction and the rate of penetration of the drill bit may be regulated based on the obtained drilling trajectory parameter, the drilling speed parameter, the current pose of the drill bit and the current rate of penetration d of the drill bit.

A biasing force parameter and a drilling parameter are calculated based on the obtained drilling trajectory parameter, the drilling speed parameter, the current pose of the drill bit and the current rate of penetration of the drill bit. The biasing force parameter includes a well deviation parameter and an azimuth parameter. The drilling direction of the drill bit may be regulated based on the biasing force parameter. In practices, the drilling system is provided with a rotary guiding mechanism. The biasing force parameter is sent to the rotary guiding mechanism of the drilling system, and the rotary guiding mechanism may regulate the drilling direction of the drill bit based on the biasing force parameter.

The drilling parameter includes a drilling pressure, a rotation speed, a pump pressure and a pump volume. The drilling system is further provided with an automatic rig for driving the drill bit. The drilling parameter is sent to the automatic rig of the drilling system, and the automatic rig may regulate the rate of penetration of the drill bit based on the drilling parameter.

In an embodiment, a preset closed-loop control model is provided to improve the control accuracy of the drilling process. The drilling trajectory parameter, the drilling speed parameter, the pose of the drill bit and the current rate of penetration of the drill bit are inputted to the preset closed-loop control model, and the biasing force parameter and the drilling parameter are outputted from the preset closed-loop control model. Based on the parameters, the drilling process is controlled in a closed loop.

In practices, the drilling trajectory parameter and the drilling speed parameter outputted by the drilling parameter modification model described in previous steps are determined as standard values, the current drilling trajectory corresponding to the current pose of the drill bit and the current rate of penetration of the drill bit are determined as actual values, and that the errors between the standard values and actual values are controlled to be within a preset range is determined as the purpose of the closed-loop control process. The biasing force parameter and the drilling parameter are continuously regulated by using the preset closed-loop control model, thereby performing closed-loop control simultaneously on the drilling direction of the drill bit and the rate of penetration of the drill bit.

It should be noted that the process of determining the actual drilling trajectory of the drill bit based on the current pose of the drill bit may be performed according to the conventional technology and is not limited in the present disclosure.

In this step, an error calculation is performed by using the preset the closed-loop control model based on the standard values and the actual values to regulate the biasing force and the rate of penetration of the drill bit, thereby independently performing the closed-loop servo control on the drilling direction and the rate of penetration of the drill bit.

With the drilling method according to the present disclosure, the drilling system can independently regulate the drilling direction and the rate of penetration of the drill bit and independently control the operation of the drill bit, independently performing the drilling process without depending on the control information of the wellsite system. The limitation of the reliability and efficiency of the transmission of the well-ground data according to the conventional technology does not affect the drilling process, thereby overcoming the shortcomings of the conventional technology and improving the safety of the drilling process.

Furthermore, with the method, the dependence on engineers of the drilling process according to the conventional technology can be overcome, reducing the influence of personnel experiences on the drilling process.

In an embodiment, after the drilling trajectory parameter and the drilling speed parameter are obtained in step S120, if communication conditions permit, the obtained drilling trajectory parameter and the obtained drilling speed parameter may be sent to a wellsite control system for reference by the technicians at the wellsite to learn the drilling process timely and intervene in the drilling process when necessary.

It should be noted that although the above operations are described in a specific order, it should not be understood that these operations are required to be performed in the specific order or performed in a sequential order. In some conditions, multitasking and parallel processing may be advantageous.

It should be understood that the steps in the method embodiments of the present disclosure may be performed in different orders and/or in parallel. In addition, the method embodiments may include an additional step and/or an omitted step that is not shown herein. The scope of the present disclosure is not limited in this aspect.

A drilling apparatus according to an embodiment of the present disclosure is described below. The drilling apparatus described below may be considered as a functional module architecture required to be provided in a central device to perform the drilling method according to the embodiments of the present disclosure. The following descriptions may cross-reference with the above descriptions.

Figure 2:
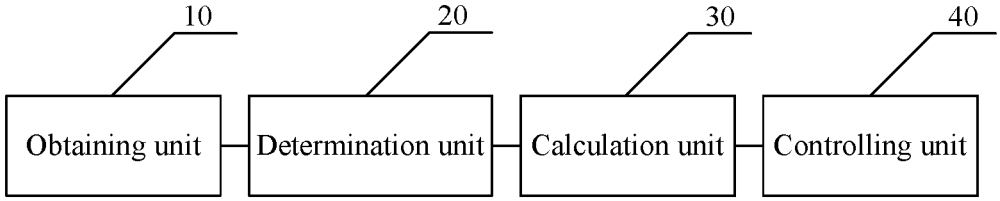
FIG. 2 is a block diagram of a structure of a drilling apparatus according to an embodiment of the present disclosure.

Reference is made to FIG. 2, which is a block diagram of a structure of a drilling apparatus according to an embodiment of the present disclosure. As shown in FIG. 2, the drilling apparatus according to the embodiment of the present disclosure includes an obtaining unit 10, a determination unit 20, a calculation unit 30 and a controlling unit 40.

The obtaining unit 10 is configured to obtain a feature parameter of a stratum around a well, a feature parameter of a stratum in front of a drill bit, a preset drilling parameter, a preset trajectory parameter, a current pose of the drill bit, and a current rate of penetration of the drill bit.

The determination unit 20 is configured to determine, based on the feature parameter of the stratum around the well and the feature parameter of the stratum in front of the drill bit, a feature parameter of a reservoir in front of the drill bit.

The calculation unit 30 is configured to input the preset drilling parameter, the preset trajectory parameter, the current pose of the drill bit and the feature parameter of the reservoir to a pre-trained drilling parameter modification model to obtain a drilling trajectory parameter and a drilling speed parameter.

The controlling unit 40 is configured to regulate a drilling direction and a rate of penetration of the drill bit based on the drilling trajectory parameter, the drilling speed parameter, the current pose of the drill bit and the current rate of penetration of the drill bit.

In an embodiment, the controlling unit 40, in regulating the drilling direction and the rate of penetration of the drill bit based on the drilling trajectory parameter, the drilling speed parameter, the current pose of the drill bit and the current rate of penetration of the drill bit, is configured to:

calculate a biasing force parameter and a drilling parameter based on the drilling trajectory parameter, the drilling speed parameter, the current pose of the drill bit and the current rate of penetration of the drill bit;

send the biasing force parameter to a rotary guiding mechanism of the drilling system to regulate the drilling direction of the drill bit by the rotary guiding mechanism based on the biasing force parameter; and send the drilling parameter to an automatic rig of the drilling system to regulate the rate of penetration of the drill bit by the automatic rig based on the drilling parameter.

In an embodiment, the controlling unit 40, in calculating the biasing force parameter and the drilling parameter based on the drilling trajectory parameter, the drilling speed parameter, the current pose of the drill bit and the current rate of penetration of the drill bit, is configured to:

call a preset closed-loop control model, and input the drilling trajectory parameter, the drilling speed parameter, the current pose of the drill bit and the current rate of penetration of the drill bit to the preset closed-loop control model to obtain the biasing force parameter and the drilling parameter.

In an embodiment, the determination unit 20, in determining the feature parameter of the reservoir in front of the drill bit based on the feature parameter of the stratum around the well and the feature parameter of the stratum in front of the drill bit, is configured to:

call a pre-trained parameter inversion model, wherein the parameter inversion model is obtained by training an artificial intelligence model using feature parameters of stratums around a well and feature parameters of stratums in front of a drill bit as inputs and using feature parameters of reservoirs as outputs; and input the feature parameter of the stratum around the well and the feature parameter of the stratum in front of the drill bit to the parameter inversion model to obtain the feature parameter of the reservoir in front of the drill bit.

Figure 3:
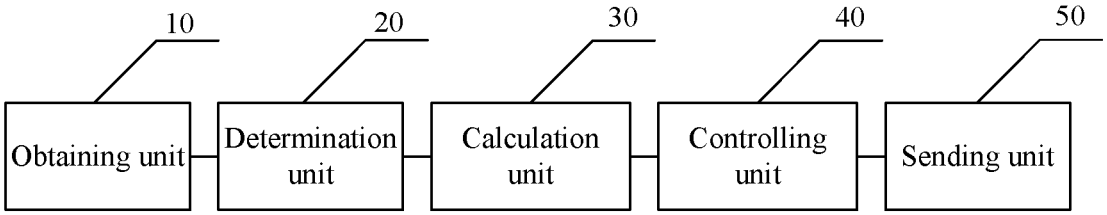
FIG. 3 is a block diagram of a structure of a drilling apparatus according to another embodiment of the present disclosure.

Reference is made to FIG. 3, which is a block diagram of a structure of a drilling apparatus according to another embodiment of the present disclosure. Based on the embodiment shown in FIG. 2, the apparatus further includes a sending unit 50.

The sending unit 50 is configured to send the drilling trajectory parameter and the drilling speed parameter to a wellsite control system.

It should be noted that the units described in the embodiments of the present disclosure may be implemented by software or hardware. The name of the unit does not limit the unit. For example, the obtaining unit may be described as "a unit for obtaining parameters".

Although the subject of the present disclosure has been described according to the structural features and/or logical actions of the method, it should be understood that the subject defined in the claims is not necessarily limited to the features or actions described above. The specific features and actions described above are only examples of the implementation of the claims.

Although multiple implementation details are included in the above descriptions, the details should not be interpreted as limitations to the scope of the present disclosure. Some features described in an embodiment may be implemented in combination in another embodiment. In addition, the features described in an embodiment may be implemented individually or in any suitable sub-combination form in multiple embodiments.

The above descriptions are only preferred embodiments of the present disclosure and explanations of the technical principles used in the present disclosure. Those skilled in the art should understand that the scope of the present disclosure is not limited to the technical solution formed by combination of the technical features described above, but also covers other technical solutions formed by any combination of the above technical features or the equivalent features of the technical features without departing from the concept of the present disclosure. For example, the scope of the present disclosure may cover a technical solution formed by replacing the features described above with technical features with similar functions disclosed in (but not limited to) the present disclosure.

The invention claimed is:

1. A drilling method, applied to a drilling system, wherein the method comprises:

obtaining a feature parameter of a stratum around a well, a feature parameter of a stratum in front of a drill bit, a preset drilling parameter, a preset trajectory parameter, a current pose of the drill bit, and a current rate of penetration of the drill bit, wherein the feature parameter of the stratum around the well at least comprises an azimuth acoustic wave electromagnetic wave imaging parameter, a resistivity imaging parameter, an azimuth acoustic imaging parameter, a neutron parameter, a density parameter, a gamma energy spectrum parameter, a nuclear magnetic resonance parameter and a stratum testing- sampling parameter;

determining, based on the feature parameter of the stratum around the well and the feature parameter of the stratum in front of the drill bit, a feature parameter of a reservoir in front of the drill bit;

inputting the preset drilling parameter, the preset trajectory parameter, the current pose of the drill bit and the feature parameter of the reservoir to a pre-trained drilling parameter modification model to obtain a drilling trajectory parameter and a drilling speed parameter; and regulating a drilling direction and a rate of penetration of the drill bit based on the drilling trajectory parameter, the drilling speed parameter, the current pose of the drill bit and the current rate of penetration of the drill bit without depending on control information of a wellsite control system;

wherein the determining, based on the feature parameter of the stratum around the well and the feature parameter of the stratum in front of the drill bit, a feature parameter of a reservoir in front of the drill bit comprises:

calling a pre-trained parameter inversion model, wherein the parameter inversion model is obtained by training an artificial intelligence model using feature parameters of stratums around a well and feature parameters of stratums in front of a drill bit as inputs and using feature parameters of reservoirs as outputs; and inputting the feature parameter of the stratum around the well and the feature parameter of the stratum in front of the drill bit to the parameter inversion model to obtain the feature parameter of the reservoir in front of the drill bit.

2. The drilling method according to claim 1, wherein the regulating a drilling direction and a rate of penetration of the drill bit based on the drilling trajectory parameter, the drilling speed parameter, the current pose of the drill bit and the current rate of penetration of the drill bit comprises:

calculating a biasing force parameter and a drilling parameter based on the drilling trajectory parameter, the drilling speed parameter, the current pose of the drill bit and the current rate of penetration of the drill bit;

sending the biasing force parameter to a rotary guiding mechanism of the drilling system to regulate the drilling direction of the drill bit by the rotary guiding mechanism based on the biasing force parameter; and sending the drilling parameter to an automatic rig of the drilling system to regulate the rate of penetration of the drill bit by the automatic rig based on the drilling parameter.

3. The drilling method according to claim 2, wherein the calculating a biasing force parameter and a drilling parameter based on the drilling trajectory parameter, the drilling speed parameter, the current pose of the drill bit and the current rate of penetration of the drill bit comprises:

calling a preset closed-loop control model; and inputting the drilling trajectory parameter, the drilling speed parameter, the current pose of the drill bit and the current rate of penetration of the drill bit to the preset closed-loop control model to obtain the biasing force parameter and the drilling parameter.

4. The drilling method according to claim 1, further comprising:

sending the drilling trajectory parameter and the drilling speed parameter to the wellsite control system.

5. A drilling apparatus, comprising:

an obtainer, configured to obtain a feature parameter of a stratum around a well, a feature parameter of a stratum in front of a drill bit, a preset drilling parameter, a preset trajectory parameter, a current pose of the drill bit and a current rate of penetration of the drill bit, wherein the feature parameter of the stratum around the well at least comprises an azimuth acoustic wave electromagnetic wave imaging parameter, a resistivity imaging parameter, an azimuth acoustic imaging parameter, a neutron parameter, a density parameter, a gamma energy spectrum parameter, a nuclear magnetic resonance parameter and a stratum testing-sampling parameter;

a determiner, configured to determine, based on the feature parameter of the stratum around the well and the feature parameter of the stratum in front of the drill bit, a feature parameter of a reservoir in front of the drill bit;

a calculator, configured to input the preset drilling parameter, the preset trajectory parameter, the current pose of the drill bit and the feature parameter of the reservoir to a pre-trained drilling parameter modification model to obtain a drilling trajectory parameter and a drilling speed parameter; and a controller, configured to regulate a drilling direction and a rate of penetration of the drill bit based on the drilling trajectory parameter, the drilling speed parameter, the current pose of the drill bit and the current rate of penetration of the drill bit without depending on control information of a wellsite control system;

wherein the determiner, in determining the feature parameter of the reservoir in front of the drill bit based on the feature parameter of the stratum around the well and the feature parameter of the stratum in front of the drill bit, is configured to:

call a pre-trained parameter inversion model, wherein the parameter inversion model is obtained by training an artificial intelligence model using feature parameters of stratums around a well and feature parameters of stratums in front of a drill bit as inputs and using feature parameters of reservoirs as outputs; and input the feature parameter of the stratum around the well and the feature parameter of the stratum in front of the drill bit to the parameter inversion model to obtain the feature parameter of the reservoir in front of the drill bit.

6. The drilling apparatus according to claim 5, wherein the controller, in regulating the drilling direction and the rate of penetration of the drill bit based on the drilling trajectory parameter, the drilling speed parameter, the current pose of the drill bit and the current rate of penetration of the drill bit, is configured to:

calculate a biasing force parameter and a drilling parameter based on the drilling trajectory parameter, the drilling speed parameter, the current pose of the drill bit and the current rate of penetration of the drill bit;

send the biasing force parameter to a rotary guiding mechanism of the drilling system to regulate the drilling direction of the drill bit by the rotary guiding mechanism based on the biasing force parameter; and send the drilling parameter to an automatic rig of the drilling system to regulate the rate of penetration of the drill bit by the automatic rig based on the drilling parameter.

7. The drilling apparatus according to claim 6, wherein the controller, in calculating the biasing force parameter and the drilling parameter based on the drilling trajectory parameter, the drilling speed parameter, the current pose of the drill bit and the current rate of penetration of the drill bit, is configured to:

call a preset closed-loop control model; and input the drilling trajectory parameter, the drilling speed parameter, the current pose of the drill bit and the current rate of penetration of the drill bit to the preset closed-loop control model to obtain the biasing force parameter and the drilling parameter.

8. The drilling apparatus according to claim 5, further comprising:

a sender, configured to send the drilling trajectory parameter and the drilling speed parameter to the wellsite control system.

* * * * *